US007004250B2

(12) United States Patent
Henneicke

(10) Patent No.: US 7,004,250 B2
(45) Date of Patent: Feb. 28, 2006

(54) SEALING SYSTEM FOR THE INTERSPACE IN THE TRANSITION REGION BETWEEN TWO WELL PIPES OF DIFFERENT DIAMETERS, AND MOUNTING TOOL FOR THIS

(75) Inventor: Friedrich Henneicke, Wittingen (DE)

(73) Assignee: H. Butting GmbH & Co. KG, Wittingen-Knesebeck (DE)

( * ) Notice: Subject to any disclaimer, the term of this patent is extended or adjusted under 35 U.S.C. 154(b) by 196 days.

(21) Appl. No.: 10/696,576

(22) Filed: Oct. 30, 2003

(65) Prior Publication Data

US 2005/0039908 A1 Feb. 24, 2005

(30) Foreign Application Priority Data

Nov. 2, 2002 (DE) ..... 102 51 078

(51) Int. Cl.
*E21B 17/03* (2006.01)
*E21B 23/00* (2006.01)

(52) U.S. Cl. ..... 166/242.6; 166/240; 166/237

(58) Field of Classification Search ..... 166/242.6, 166/242.7, 237, 240
See application file for complete search history.

(56) References Cited

U.S. PATENT DOCUMENTS 1,772,682 A 8/1930 Phipps
2,447,629 A * 8/1948 Beissinger et al. ..... 166/207
3,433,303 A * 3/1969 Clark, Jr. et al. ..... 166/184
3,669,190 A * 6/1972 Sizer et al. ..... 166/387
4,611,662 A * 9/1986 Harrington ..... 166/339
5,261,492 A * 11/1993 Duell et al. ..... 166/387
6,857,473 B1 * 2/2005 Cook et al. ..... 166/212

FOREIGN PATENT DOCUMENTS

| | | |
|---|---|---|
| DE | 79 09 727 | 4/1979 |
| DE | 79 09 727 U1 | 4/1979 |
| DE | 3034992 A1 | 4/1982 |
| DE | 43 38 518 | 5/1995 |

* cited by examiner

*Primary Examiner*—Jennifer H Bay
*Assistant Examiner*—Ngoc Kinney
(74) *Attorney, Agent, or Firm*—Whitham, Curtis & Christofferson, P.C.

(57) ABSTRACT

A sealing system for the interspace in the transition region between two well pipes of different diameters, and a mounting tool for producing the sealing connection. The mounting tool is lowered via a drilling string through a larger diameter pipe and, with a sealing system, is placed on a holding docket on the upper end of a lower, smaller diameter, pipe. A rotation exerted on the mounting tool via the drilling string; causes the sealing system to be fixed to the lower pipe. Via the drilling string, the mounting tool is pressed vertically downwards against a sealing ring of the sealing system which, as a result, bears in a sealing manner against the inner wall of the upper pipe of larger diameter. This sealing position is fixed by rotating the mounting tool in one direction and by rotating the mounting tool in the other direction.

6 Claims, 6 Drawing Sheets

SEALING SYSTEM FOR THE INTERSPACE IN THE TRANSITION REGION BETWEEN TWO WELL PIPES OF DIFFERENT DIAMETERS, AND MOUNTING TOOL FOR THIS

BACKGROUND OF THE INVENTION

1. Field of the Invention

The invention relates to a sealing system for the interspace in the transition region between two well pipes of different diameters, in particular an upper supporting pipe of larger diameter with a lower filter pipe of smaller diameter, and a mounting tool for producing the sealing connection.

2. Background Description

As a rule, a well comprises a system of pipes of different diameters. In the upper part of the system, in the region of the layers which do not carry water, there is a pipe of larger diameter which supports the well bore. In the lower part, in the region of the layers which carry water, there is the pipe of smaller diameter, in which filters are provided. Around the pipe of smaller diameter, the borehole is filled with gravel, through which the water passes via the aforementioned filters into the pipe of smaller diameter, in which there are also submersible pumps which pump the water through pipes to the surface. The pipes of different diameters overlap over a distance of 2–3 m.

In order to prevent gravel or water rising in the gravel layer and thus gravel and unfiltered water being able to flow back into the interior of the filter pipe via the upper supporting pipe, there is a desire to seal off the lower part, comprising the filter pipe with the gravel jacket surrounding it, with respect to the upper part of the system, comprising the supporting pipe.

BRIEF SUMMARY OF THE INVENTION

The invention is based on the object, for such a bottom seal, of developing an effective sealing system which may be mounted from above through the upper supporting pipe of larger diameter.

On the basis of the sealing system described at the beginning, according to the invention this object is achieved by the following features:

a) a holding socket, which can be fixed firmly such that it cannot rotate on the free upper end of the lower filter pipe of smaller diameter and has at least one locking pin which projects out of its circumferential surface in the radial direction;

b) a sealing sleeve which can be pushed onto the holding socket and has a locking groove which opens at its lower edge, is used to hold the locking pin and which has a clamping section which rises in the clockwise direction and an axial latching section which adjoins the latter;

c) a tool guide in the form of a pipe connecting piece which is aligned axially with the sealing sleeve, is firmly connected to its upper end and, on its circumferential surface, in a lower cross-sectional plane, is fitted with locking lugs assigned to a clamping ring and, in an upper cross-sectional plane, is fitted with at least one holding pin assigned to the mounting tool;

d) an annular seal, which rests with its underside on an abutment which projects radially beyond the lower end of the tool guide and, on its upper side, can be acted on axially by the clamping ring pushed onto the tool guide and, as a result, can have its diameter enlarged to such an extent that it can be pressed in a sealing manner against the inner circumferential surface of the upper supporting pipe when the clamping ring assumes its clamping position under the locking lugs of the tool guide;

e) the mounting tool has a bell-shaped basic body which can be placed with its upper end fixed against rotation on a drilling string, has an external diameter which is smaller than the internal diameter of the upper supporting pipe, has at its lower edge rotation drivers to which rotation driving surfaces are assigned in the clamping ring, and which in its central region has at least one approximately j-shaped slot which is assigned to the at least one holding pin of the tool guide and which has a first vertical driver surface that rotates the holding pin and therefore the tool guide with its lower sealing sleeve in the anticlockwise direction during rotation of the mounting tool, comprises a vertical slot section permitting axial relative displacement between the basic body and tool guide as far as the form-fitting engagement of the rotation drivers behind the clamping ring driving surfaces, and has a second vertical stop surface which is assigned to the holding pin and limits rotation in order to brace the seal in a rotational position in which the clamping ring engages under the locking lugs on the tool guide.

The directions of rotation specified and the course of the slot and groove guides related to this could also occur in the opposite direction in each case.

In order to mount the sealing system according to the invention, the mounting tool screwed firmly to a drilling string with the sealing system suspended on it is lowered via the drilling string through the upper pipe of larger diameter until the sealing system with its sealing sleeve is placed on the holding socket of the lower pipe of smaller diameter. By means of a rotation exerted on the mounting tool via the drilling string, the sealing sleeve is rotated with respect to the holding socket in such a way that its locking pins enter the locking groove of the sealing sleeve and can be guided over the clamping section of the locking groove until in its latching section, as a result of which the sealing sleeve is also pulled vertically downwards relative to the holding socket, which remains in a fixed location. The rotational movement of the mounting tool for fixing the sealing sleeve to the lower filter pipe is completed when the locking pins of the holding socket latch into the aforementioned latching section of the locking groove of the sealing sleeve. The sealing sleeve is then fixed firmly against rotation with respect to the lower filter pipe.

The clamping of the seal is then carried out by means of rotational and compressive movements of the mounting tool which, in this case, exerts a vertical relative displacement and a relative rotational movement with respect to the tool guide. As a result of the vertical pressure exerted on the mounting tool via the drilling string, the clamping ring and therefore the sealing ring lying underneath it have pressure applied vertically to them, by which means the diameter of the sealing ring is enlarged to such an extent that the sealing ring is pressed in a sealing manner against the inner wall of the upper pipe of larger diameter. In order to fix this sealing position, the mounting tool pressed downwards is rotated and, via its rotation drivers, rotates the clamping ring until the latter engages in a locking manner with its locking surfaces under the locking lugs seated on the tool guide, which is fixed against rotation. The mounting tool is then uncoupled from its rotational form fit with the clamping ring by being raised, that is to say via an axial lifting movement, and then released from the holding pins of the tool guide by means of a rotation. The mounting tool can then be pulled upwards again via the drilling string; the sealing system remains in the pipe system.

Further features of the invention are the subject of the subclaims and are explained in more detail in conjunction with further advantages of the invention by using an exemplary embodiment.

DETAILED DESCRIPTION OF THE INVENTION

Illustrated in the drawings is an embodiment of the invention serving as an example. In the drawings:

BRIEF DESCRIPTION OF THE DRAWINGS

FIG. 1*b*I shows a section according to the line II-I in FIG. 1*a;*

FIG. 1*b*II shows a lower filter pipe coupled with an upper supporting pipe;

FIG. 1 shows the lowering of a mounting tool 1 with a sealing system suspended on it onto the upper end of a filter pipe 2, illustrated in FIG. 2, for the purpose of connecting it in a sealed manner to an upper supporting pipe of larger diameter, which overlaps the filter pipe 2 of smaller diameter over a distance of about 2–3 m. FIG. 1*b*II illustrates a cross-sectional view of the mounting tool 1 with an upper supporting pipe 13 of larger diameter overlapping the filter pipe 2. This therefore concerns a sealing system for a connection of two well pipes of different diameters and a mounting tool for producing the sealing connection.

Figure 1C:
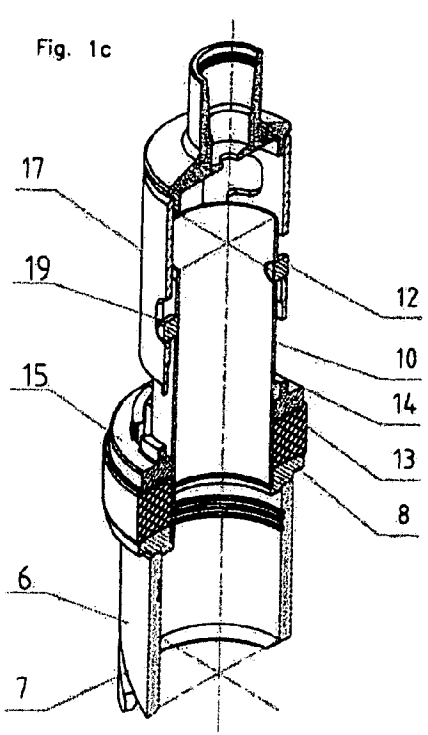
FIG. 1*c* shows the sectional illustration according to FIG. 1*b* in a perspective illustration on a somewhat enlarged scale.
Figure 1A:
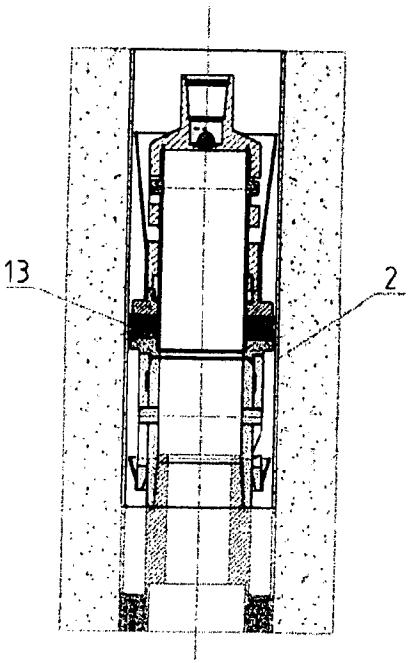
FIG. 1*a* shows a mounting tool with a sealing system suspended on it in side view.
Figure 1A:
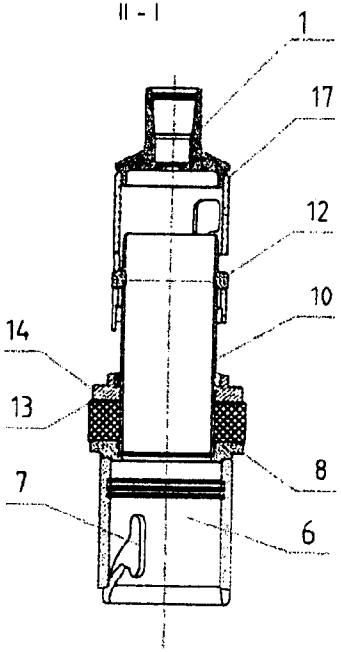
Figure 1A:
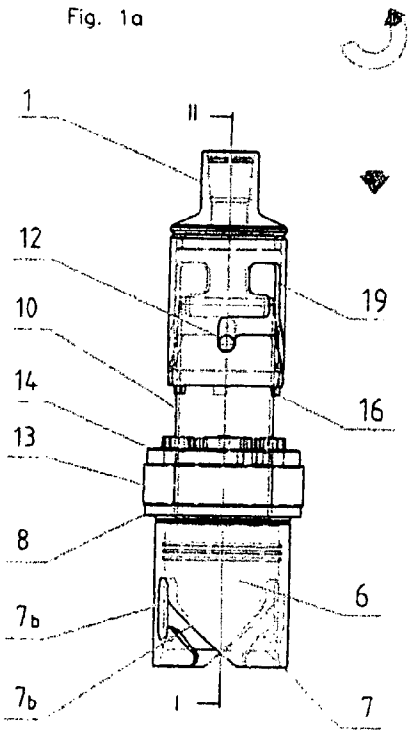
Figure 2C:
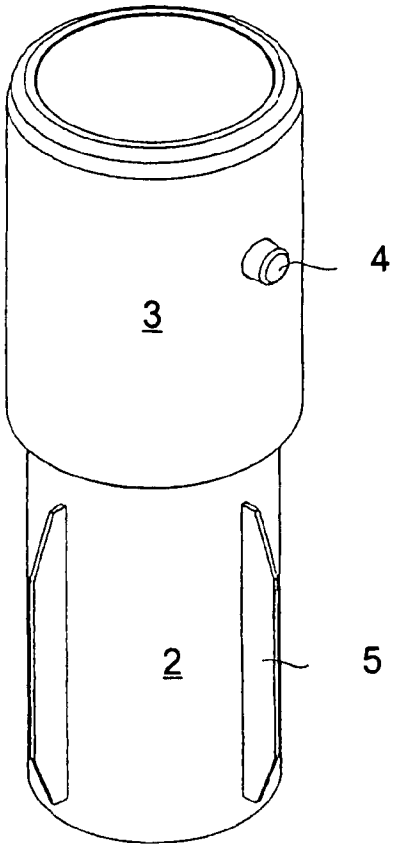
FIG. 2*c* shows the illustration according to FIG. 2*a* in a pictorial illustration.
Figure 2B:
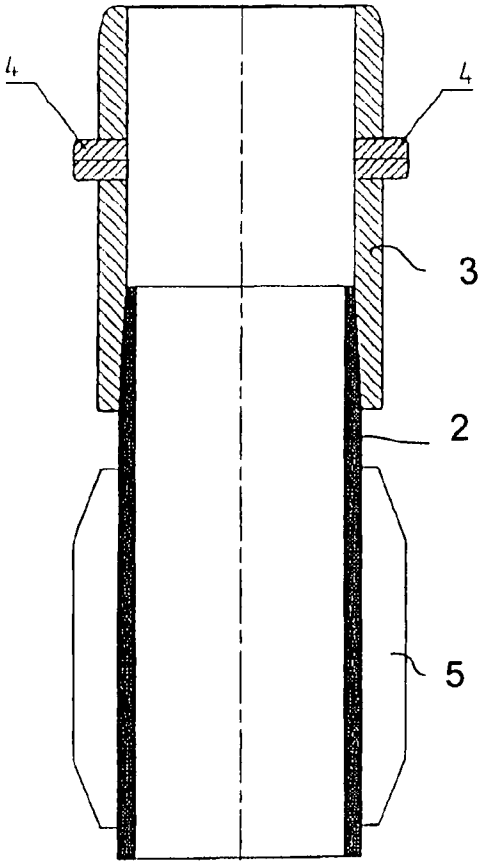
FIG. 2*b* shows a section according to the line II—II in FIG. 2*a;*
Figure 2A:
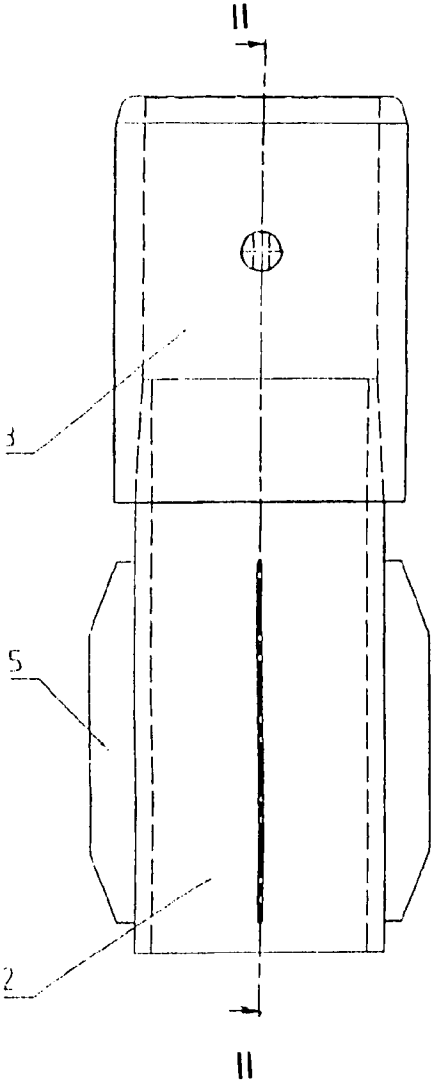
FIG. 2*a* shows the upper end of a lower filter pipe, fitted with a holding socket, in side view.
Figure 3B:
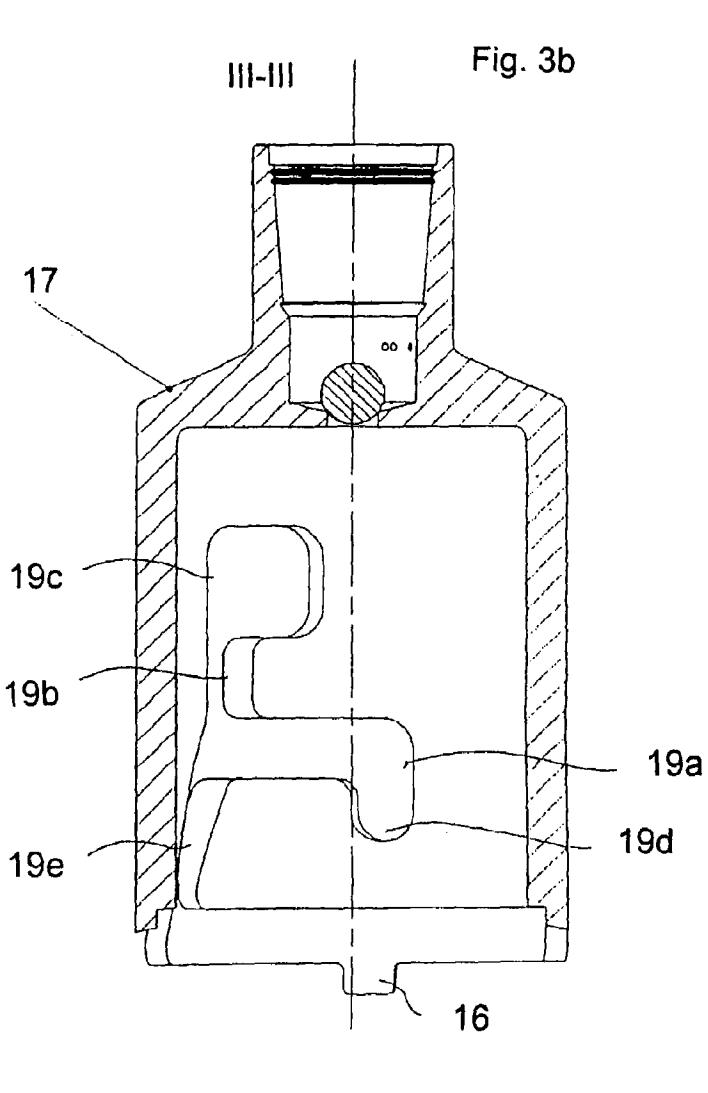
FIG. 3*b* shows a section according to the line III—III in FIG. 3*a;*
Figure 3A:
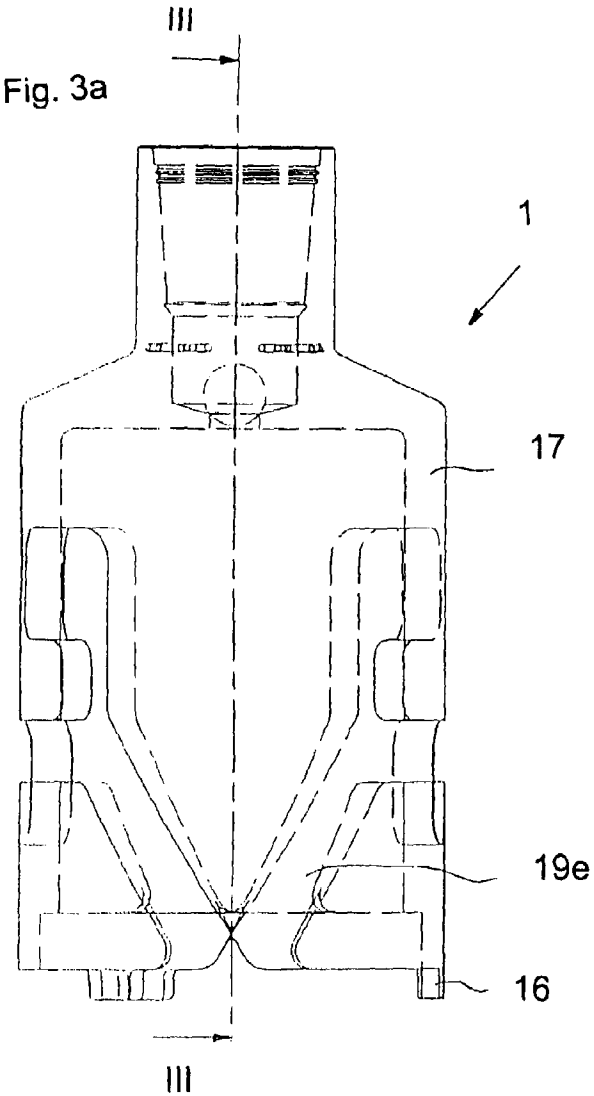
FIG. 3*a* shows the mounting tool according to FIG. 1 on its own on an enlarged scale.

According to FIG. 2, a holding socket 3 can be fixed against rotation on the free upper end of the lower filter pipe 2, said socket 3 being fitted with two mutually opposite locking pins 4 projecting radially from its circumferential surface. The filter pipe 2 is fitted on its circumferential surface with two circumferentially offset centring wings 5 in its upper end region.

Figure 4C:
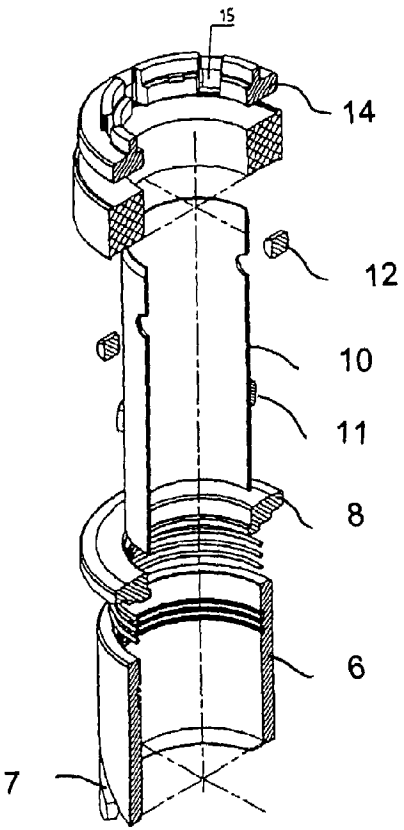
FIG. 4*c* shows a sectional illustration according to FIG. 4*b* in a perspective illustration.
Figure 4B:
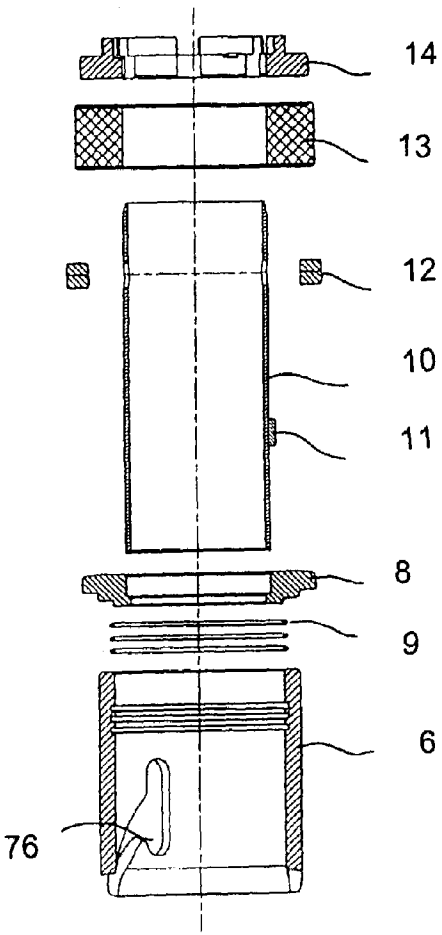
FIG. 4*b* shows a section according to the line IV—IV in FIG. 4*a;*
Figure 4A:
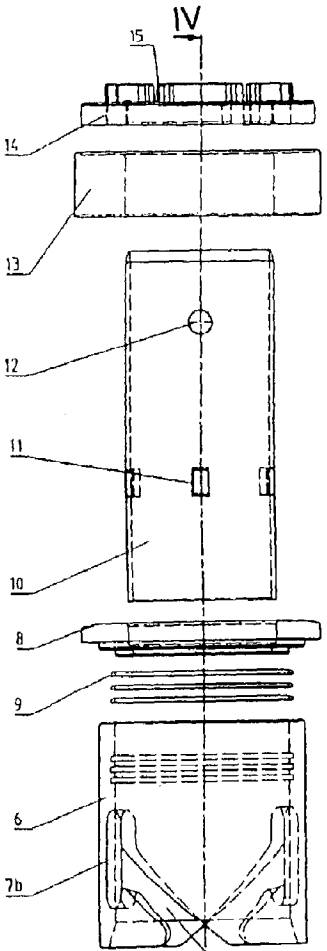
FIG. 4*a* shows the sealing system according to FIG. 1 in a side view in an exploded illustration.

The sealing system shown in an exploded illustration in FIG. 4 comprises a sealing sleeve 6, which can be pushed onto the holding socket 3 of the filter pipe 2 and has two mutually opposite locking grooves 7 which each open at its lower rim and are used to hold the locking pins 4 of the holding socket 3. Each locking groove 7 comprises a clamping section 7*a* which rises in a clockwise direction and an axial latching section 7*b* which adjoins this.

Fixed to the upper edge of the sealing sleeve 6 is an adapter ring 8 of larger diameter which is used to hold an O-ring 9 and to fix the lower end of a tool guide 10 which is constructed in the form of a pipe connecting piece and, in the mounted position, is aligned axially with the sealing sleeve 6. The tool guide 10 is fitted on its circumferential surface with locking lugs 11 in a lower cross-sectional plane and, in an upper cross-sectional plane, with two mutually opposite holding pins 12, whose function will be explained later.

The sealing system further comprises an annular seal 13, which rests on the adapter ring 8 forming an abutment for the seal 13 and, on its upper side, can be acted on axially by a clamping ring 14 pushed onto the tool guide 10 and, as a result, can have its diameter enlarged to such an extent that it can be pressed in a sealing manner against the inner circumferential surface of the upper supporting pipe. In order to fix this sealing position, the clamping ring 14 is rotated into its clamping position, in which it engages in a locking manner with locking grooves under the previously described locking lugs 11 on the circumferential surface of the tool guide 10. The clamping ring 14 has a rim of smaller diameter which is provided with axial incisions 15 which are open at the top and in which rotation drivers 16 belonging to the mounting tool 1 and described in more detail later can engage.

The mounting tool 1 has a bell-shaped basic body 17 which, by its upper end, can be fixed against rotation to a drilling string, not specifically illustrated. The largest external diameter of the basic body 17 is smaller than the internal diameter of the upper supporting pipe through which the mounting tool 1 can be lowered in order to produce the sealing connection with the lower filter pipe 2. At its lower rim, the basic body 17 is fitted with the rotation drivers 16 already mentioned previously.

Figure 5C:
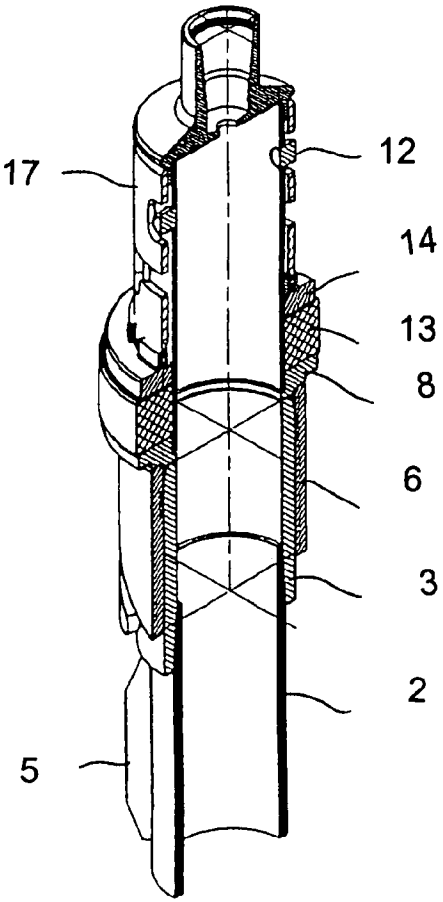
FIG. 5*c* shows the sectional illustration according to FIG. 5*b* in a perspective illustration.
Figure 5B:
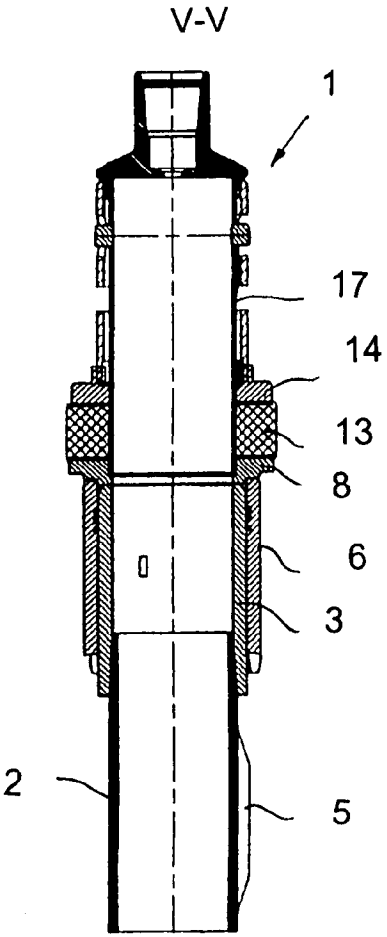
FIG. 5*b* shows a section according to the line V—V in FIG. 5*a;*
Figure 5A:
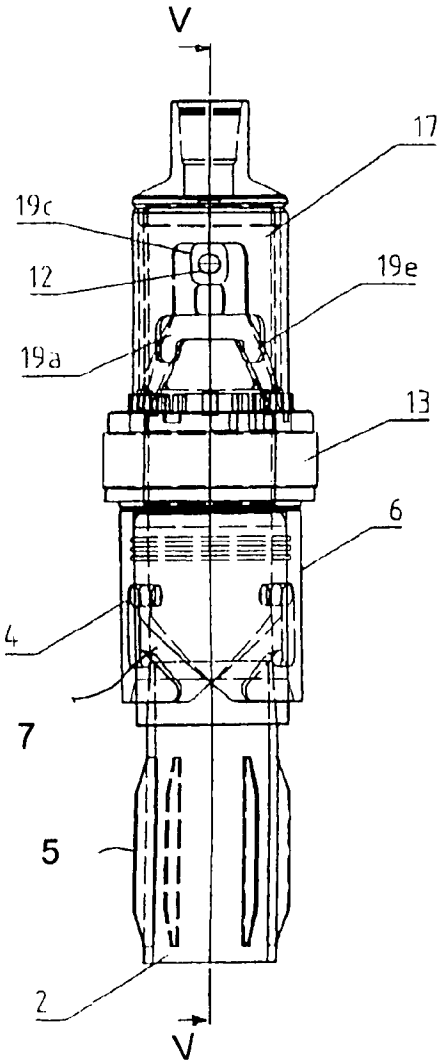
FIG. 5*a* shows the sealing system according to FIG. 1 placed on the lower filter pipe according to FIG. 2 with the mounting tool in a position fixing the sealing system.

In its central region, the basic body 17 has two mutually opposite j-shaped slots 19, to which the two holding pins 12 already mentioned above of the tool guide 10 are assigned. Each j-shaped slot 19 has a first vertical driver surface 19*a* which, during rotation of the mounting tool 1 in the anticlockwise direction, rotates the holding pin 12 resting on it, and therefore the tool guide 10 with its lower sealing sleeve 6, such that the locking pins 4 of the holding socket 3 enter the clamping section 7*a* of the locking groove 7 of the sealing sleeve 6 until they have reached the latching section 7*b* of the locking groove 7, as FIG. 5 reveals. In this position, the sealing sleeve 6 is then firmly connected to the holding socket 3 so as not to rotate, and therefore to the lower filter pipe 2.

Each j-shaped slot 19 further comprises a vertical slot section 19*b* which permits an axial relative displacement between basic body 17 and tool guide 10, so that the mounting tool 1 pressed on vertically downwards can engage with its rotation drivers 16 in the incisions 15 of the clamping ring 14 and therefore behind the clamping ring driving surfaces formed by these incisions 15.

Each j-shaped slot 19 further comprises a second vertical stop surface 19*c* which limits a rotation for bracing the seal 13 in a rotating position in which the clamping ring 14 engages under the locking lugs 11 on the tool guide 10; the associated holding pin 12 then strikes this second vertical stop surface 19*c*.

Each j-shaped slot 19 further has a latching support 19*d* to hold the associated holding pin when the sealing system is transported suspended on the mounting tool 1 (see FIG. 1).

In order to rotate the mounting tool 1 out of its rotary connection with the tool guide 10, each j-shaped slot 19 has a section 19*e* which runs out obliquely downwards in the anticlockwise direction.

In order to mount the sealing pipe connection, the mounting tool 1 screwed onto a drilling string, with the sealing system suspended on it, is introduced into the upper supporting pipe and then placed with the sealing sleeve 6 on the holding socket 3 of the lower filter pipe 2 in such a way that the locking pins 4 of the holding socket 3 can be introduced into the locking groove 7 of the sealing sleeve 6 by means of a rotary movement of the mounting tool 1. After the sealing system has been fixed in this way to the holding socket 3 of the filter pipe 2, the mounting tool 1 is pressed onto the sealing system by means of the drilling string. In this way, the seal 13 is compressed in such a way that, curving outwards, it presses against the inner wall of the upper pipe of larger diameter and therefore seals the upper pipe with respect to the lower pipe.

By means of subsequent rotation of the mounting tool 1, the seal 13 is fixed in this position, by the clamping ring 14 being rotated via the rotation drivers 16 of the mounting tool 1 in such a way that the said clamping ring 14 can latch in under the locking lugs 11 of the tool guide 10.

Figure 6C:
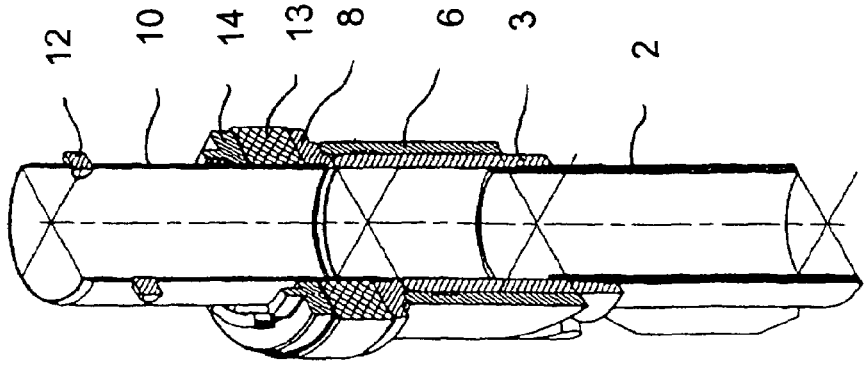
FIG. 6*c* shows the sectional illustration according to FIG. 6*b* in a perspective illustration.
Figure 6B:
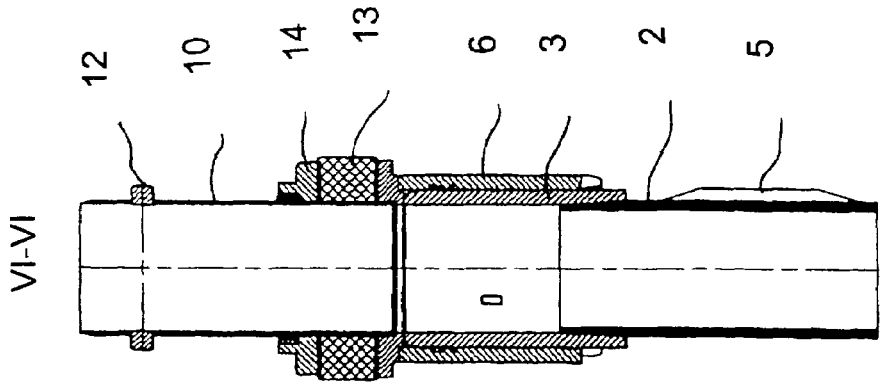
FIG. 6*b* shows a section according to the line VI—VI in FIG. 6*a;*
Figure 6A:
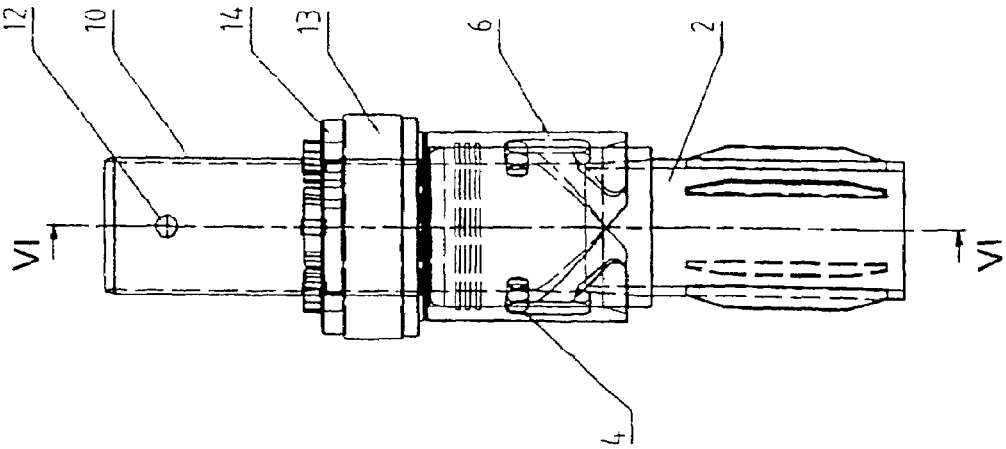
FIG. 6*a* shows the sealing system connected to the lower filter pipe in the stressed state.

After the sealing and fixing of the seal of the sealing system, the mounting tool 1 is released from the sealing system by means of an opposite rotational movement and pulled upwards with the drilling string. The sealing system remains in its locked and clamped position in the upper pipe, as depicted in FIG. 6.

What is claimed is:

1. Sealing system for the interspace in the transition region between two well pipes of different diameters, where an upper supporting pipe of said two well pipes has a larger diameter and a lower filter pipe of said two well pipes has a smaller diameter, and a mounting tool for producing the sealing connection, comprising:

a) a holding socket, which can be fixed firmly such that it cannot rotate on the free upper end of the lower filter pipe of smaller diameter and has at least one locking pin which projects out of its circumferential surface in the radial direction;

b) a sealing sleeve which can be pushed onto the holding socket and has a locking groove which opens at its lower edge, is used to hold the locking pin and which has a clamping section which rises in the clockwise direction and an axial latching section which adjoins the latter;

c) a tool guide in the form of a pipe connecting piece which is aligned axially with the sealing sleeve, is firmly connected to its upper end and, on its circumferential surface, in a lower cross-sectional plane, is fitted with locking lugs assigned to a clamping ring and, in an upper cross-sectional plane, is fitted with at least one holding pin assigned to the mounting tool;

d) an annular seal, which rests with its underside on an abutment, which projects radially beyond the lower end of the tool guide and, on its upper side, can be acted on axially by the cramping ring pushed onto the tool guide and, as a result, can have its diameter enlarged to such an extent that it can be pressed in a sealing manner against the inner circumferential surface of the upper supporting pipe when the clamping ring assumes its clamping position under the locking lugs of the tool guide;

e) the mounting tool has a bell-shaped basic body which can be placed with its upper end fixed against rotation on a drilling string, has an external diameter which is smaller than the internal diameter of the upper supporting pipe, has at its lower edge rotation drivers to which rotation driving surfaces are assigned in the clamping ring, and which in its central region has at least one approximately j-shaped slot which is assigned to the at least one holding pin of the tool guide and which has a first vertical driver surface that rotates the holding pin and therefore the tool guide with its lower sealing sleeve in the anticlockwise direction during rotation of the mounting tool, comprises a vertical slot section permitting axial relative displacement between the basic body and tool guide as far as the form-fitting engagement of the rotation drivers behind the clamping ring driving surfaces, and has a second vertical stop surface which is assigned to the holding pin and limits a rotation in order to brace the seal in a rotational position which the clamping ring engages under the locking lugs on the tool guide.

2. Sealing system according to claim 1, wherein the abutment for the seal is formed by an adapter ring fixed to the upper end of the sealing sleeve.

3. Sealing system according to claim 2, wherein an 0-ring is inserted into the adapter ring.

4. Sealing system according to claim 1, wherein the clamping ring has a rim of smaller diameter which is provided with axial incisions which are open at the top and form the rotation driving surfaces, in which the rotation drivers of the mounting tool engage during its axial displacement with respect to the tool guide.

5. Sealing system according to claim 1, wherein the j-shaped slot in the mounting tool has a latching support for the holding pin when the sealing system is transported suspended on the mounting tool.

6. Sealing system according to claim 1, wherein the j-shaped slot has a section which runs out obliquely downwards in the anticlockwise direction in order to rotate the mounting tool out of its rotary connection with the tool guide.

* * * * *